US008220525B2

(12) United States Patent
Cho et al.

(10) Patent No.: US 8,220,525 B2
(45) Date of Patent: Jul. 17, 2012

(54) METHOD FOR PREDICTING SURFACE QUALITY OF THIN SLAB HOT ROLLED COIL AND METHOD FOR PRODUCING THIN SLAB HOT ROLLED COIL USING THE SAME

(75) Inventors: Wonjae Cho, Dangjin-gun (KR); Hyojoong Kwon, Gwangju-si (KR); Kyoungho So, Namwon-si (KR); Kaeyoung Lee, Dangjin-gun (KR); Jutae Choi, Seoul (KR); Jinsoo Jang, Goyang-si (KR); Sukhyun Yoo, Dangjin-gun (KR)

(73) Assignee: Hyundai Steel Company, Incheon (KR)

( * ) Notice: Subject to any disclaimer, the term of this patent is extended or adjusted under 35 U.S.C. 154(b) by 0 days.

(21) Appl. No.: 13/310,132

(22) Filed: Dec. 2, 2011

(65) Prior Publication Data

US 2012/0073778 A1 Mar. 29, 2012

Related U.S. Application Data

(63) Continuation of application No. PCT/KR2010/004130, filed on Jun. 25, 2010.

(30) Foreign Application Priority Data

Jun. 26, 2009 (KR) ..... 10-2009-0057881
Jul. 24, 2009 (KR) ..... 10-2009-0068093
Aug. 27, 2009 (KR) ..... 10-2009-0079868

(51) Int. Cl.
*B22D 11/16* (2006.01)

(52) U.S. Cl. ..... 164/451; 164/452; 164/476

(58) Field of Classification Search ..... 164/451, 164/452, 459; 700/146–148
See application file for complete search history.

(56) References Cited

U.S. PATENT DOCUMENTS

2007/0181284 A1* 8/2007 Albrecht-Fruh et al. ..... 164/480

FOREIGN PATENT DOCUMENTS

JP 06-304606 A 11/1994
JP 08-281385 A 10/1996

(Continued)

OTHER PUBLICATIONS

International Search Report dated Feb. 1, 2011 of PCT/KR2010/004130 and its English Translation (4 pages).

(Continued)

*Primary Examiner* — Jessica L Ward
*Assistant Examiner* — Kevin E Yoon
(74) *Attorney, Agent, or Firm* — Knobbe Martens Olson & Bear LLP

(57) ABSTRACT

Disclosed is a method of predicting surface quality of a thin slab hot rolled coil. The method includes calculating the Cu equivalent (Cu eq.) of molten steel, applying the calculated Cu equivalent of the molten steel into an equation: 120×(Cu equivalent)$^2$−6×(Cu equivalent) to calculate a surface crack index, and predicting the generation of surface defect of the thin slab hot rolled coil by the surface crack index. A method of producing the thin slab hot rolled coil using the same is also provided. The surface crack defect of the thin slab hot rolled coil can be predicted by calculating the Cu equivalent of the molten steel, and thus a thin slab which meets the quality standard demanded by a consumer can be provided, and this results in increased productivity and product reliability.

14 Claims, 3 Drawing Sheets

SURFACE CRACK INDEX Vs Cu eq.(X100%)+1.5*COIL THICKNESS

FOREIGN PATENT DOCUMENTS

| | | | | |
|---|---|---|---|---|
| JP | 08277423 | A | * | 10/1996 |
| JP | 09253814 | A | * | 9/1997 |
| JP | 2000-178655 | A | | 6/2000 |
| JP | 2005-240158 | A | | 9/2005 |
| KR | 10-2001-0047209 | A | | 6/2001 |
| KR | 10-2002-0001440 | A | | 1/2002 |

OTHER PUBLICATIONS

Written Opinion dated Feb. 1, 2011 of PCT/KR2010/004130 (3 pages).

* cited by examiner

<SURFACE CRACK GENERATED ON SURFACE OF HOT ROLLED COIL>

SURFACE CRACK INDEX Vs Cu

SURFACE CRACK INDEX Vs Cu eq.

SURFACE CRACK INDEX Vs Cu eq.(X100%)+1.5*COIL THICKNESS

METHOD FOR PREDICTING SURFACE QUALITY OF THIN SLAB HOT ROLLED COIL AND METHOD FOR PRODUCING THIN SLAB HOT ROLLED COIL USING THE SAME

RELATED APPLICATION

This application is a continuation application under 35 U.S.C. §365(c) of International Application No. PCT/KR2010/004130, filed Jun. 25, 2010 designating the United States. This application further claims the benefit of the earlier filing date under 35 U.S.C. §365(b) of Korean Patent Application No. 10-2009-0057881 filed Jun. 26, 2009, Korean Patent Application No. 10-2009-0068093 filed Jul. 24, 2009 and Korean Patent Application No. 10-2009-0079868 filed Aug. 27, 2009. This application incorporates herein by reference the International Application No. PCT/KR2010/004130 and the Korean Patent Application Nos. 10-2009-0057881, 10-2009-0068093 and 10-2009-0079868 in their entirety.

TECHNICAL FIELD

The present disclosure relates to a method of predicting surface quality of a thin slab hot rolled coil and a method of producing a thin slab hot rolled coil using the same.

BACKGROUND ART

In a slab casting process, a thin slab is cast in a form close to a final product and is cast to have smaller thickness, and a roughing rolling process can be omitted in hot rolling plants, and thus the thin slab process is mainly employed for omission and simplification.

Unlike a general continuous casting process, when such a thin slab continuous casting process is performed, a thin slab can be cast at a rapid rate, and also solidifying molten steel in a liquid phase into a thin slab is completely carried out in a mold and a strand, and thus fine crystalline grains can be obtained when compared to the typical slab.

SUMMARY

Accordingly, an aspect of the present invention is to provide a method of predicting surface quality of a thin slab hot rolled coil, in which the Cu equivalent (Cu eq.) of molten steel is measured and thus a surface crack index is calculated for improving the surface quality of the thin slab hot rolled coil, and a method of producing the thin slab hot rolled coil using the same.

Another aspect of the present invention is to provide a method of predicting surface quality of a thin slab hot rolled coil, in which a surface crack index is calculated from the Cu equivalent (Cu eq.) of molten steel and a coil thickness for improving the surface quality of the thin slab hot rolled coil, and a method of producing the thin slab hot rolled coil using the same.

A further aspect of the present invention is to provide a method of predicting surface quality of a thin slab hot rolled coil, in which a surface crack index is calculated from the Cu equivalent (Cu eq.) of molten steel and a coil thickness and the coil thickness to be produced is determined based on the calculated surface crack index for improving the surface quality of the thin slab hot rolled coil, and a method of producing the thin slab hot rolled coil using the same.

Embodiments of the present invention provides a method of predicting surface quality of a thin slab hot rolled coil, the method comprising calculating a Cu equivalent (Cu eq.) of molten steel, applying the calculated Cu equivalent of the molten steel into an equation: $120\times(\text{Cu equivalent})^2-6\times(\text{Cu equivalent})$ to calculate a surface crack index, and predicting generation of a surface defect of the thin slab hot rolled coil by using the surface crack index.

In addition, embodiments of the present invention provides a method of predicting surface quality of a thin slab hot rolled coil, the method comprising calculating a Cu equivalent (Cu eq.) of molten steel, substituting the calculated Cu equivalent of the molten steel and a coil thickness to be produced into an equation: $(\text{Cu equivalent}\times100)+(1.5\times\text{coil thickness})$ to determine a correction value A, applying the correction value A into an equation: $0.0067\times A^2-0.088\times A$ to calculate a surface crack index, and predicting generation of a surface defect of the thin slab hot rolled coil by using the surface crack index.

The Cu equivalent (Cu eq.) may be calculated by an equation: [wt % Cu]+5[wt % Sn]+8[wt % Sb]−[wt % Ni] [wherein wt % is an amount of each of elements].

Furthermore, the amount of each of Cu, Sn, Sb and Ni for calculating the Cu equivalent may be measured by sampling the molten steel immediately before continuous casting after completion of refining.

In addition, embodiments of the present invention provides a method of producing a thin slab hot rolled coil, the method comprising calculating a Cu equivalent (Cu eq.) of molten steel, applying the calculated Cu equivalent of the molten steel into an equation: $120\times(\text{Cu equivalent})^2-6\times(\text{Cu equivalent})$ to calculate a surface crack index, continuously casting the molten steel having the calculated surface crack index of 1 or less into a thin slab, and then hot rolling the thin slab into a hot rolled coil.

In addition, embodiments of the present invention provides a method of producing a thin slab hot rolled coil, the method comprising calculating a Cu equivalent (Cu eq.) of molten steel, applying the calculated Cu equivalent of the molten steel and a coil thickness to be produced into an equation: $(\text{Cu equivalent}\times100)+(1.5\times\text{coil thickness})$ to determine a correction value A, applying the correction value A into an equation: $0.0067\times A^2-0.088\times A$ to calculate a surface crack index, and continuously casting the molten steel having the calculated surface crack index of 1 or less into a thin slab, and then hot rolling the thin slab into a hot rolled coil.

In addition, embodiments of the present invention provides a method of producing a thin slab hot rolled coil, the method comprising calculating a Cu equivalent (Cu eq.) of molten steel, applying the calculated Cu equivalent of the molten steel and a coil thickness to be produced into an equation: $(\text{Cu equivalent}\times100)+(1.5\times\text{coil thickness})$ to determine a correction value A, applying the correction value A into an equation: $0.0067\times A^2-0.088\times A$ to calculate a surface crack index, and predicting generation of a surface defect of the thin slab hot rolled coil based on the surface crack index, re-determining the coil thickness to be produced so that the generation of the surface defect is suppressed, and then performing rolling.

In addition, embodiments of the present invention provides a method of producing a thin slab hot rolled coil, the method comprising calculating a Cu equivalent (Cu eq.) of molten steel, calculating data for predicting generation of a surface defect of the thin slab hot rolled coil based on a surface crack index deduced by correlation between the calculated Cu equivalent (Cu eq.) of the molten steel and a coil thickness, and determining the coil thickness to be produced so that the generation of the surface defect is suppressed based on the predicted data.

As such, the surface crack index may be calculated by substituting the Cu equivalent of the molten steel and the coil thickness into an equation: (Cu equivalent×100)+(1.5×coil thickness) to determine a correction value A, and then applying the correction value A into an equation: $0.0067\times A^2-0.088\times A$.

The Cu equivalent (Cu eq.) may be calculated by using an equation: [wt % Cu]+5[wt % Sn]+8[wt % Sb]−[wt % Ni] [wherein wt % is an amount of each of elements].

Furthermore, the amount of each of Cu, Sn, Sb and Ni for calculating the Cu equivalent may be measured by sampling the molten steel immediately before continuous casting after completion of refining.

According to embodiments of the present invention, the Cu equivalent (Cu eq.) of molten steel is calculated and thereby a surface crack index can be calculated, thus predicting the level of quality of a hot rolled coil produced from a thin slab. Thus, it is possible to provide the thin slab adapted for the quality standard demanded by a consumer, and to effectively increase the product reliability and the satisfaction of the consumer.

Also according to embodiments of the present invention, the surface crack index can be calculated using the Cu equivalent (Cu eq.) of molten steel and the thickness of a coil to be produced, thereby predicting the level of quality of a hot rolled coil produced from a thin slab. Ultimately, it is possible to provide the thin slab adapted for the quality standard demanded by a consumer, and to effectively increase the product reliability and the satisfaction of the consumer.

Also according to embodiments of the present invention, the level of the quality of a hot rolled coil to be produced can be predicted depending on the Cu equivalent (Cu eq.) of molten steel and a coil thickness. Thus, when the thin slab is hot rolled into the hot rolled coil, the thickness of the coil to be produced can be variably determined depending on the calculated Cu equivalent in the molten steel process, thereby achieving the hot rolled coil adapted for the quality standard demanded by a consumer.

In this case, if the Cu equivalent of the molten steel is low, the coil thickness can be determined to be thick in the range that satisfies the surface crack index. In contrast, if the Cu equivalent of the molten steel is high, the coil thickness is determined to be thin, thereby increasing an actual yield. Therefore, the product reliability and the satisfaction of a consumer can be increased, and furthermore, the actual yield of the producer can be enhanced.

MODE FOR INVENTION

Hereinafter, a detailed description will be given of embodiments of the present invention with reference to the appended drawings.

(First Embodiment)

According to embodiments of the present invention, a method of predicting surface quality of a thin slab hot rolled coil includes calculating the Cu equivalent (Cu eq.) of molten steel, applying the calculated Cu equivalent of the molten steel into an equation: $120\times(\text{Cu equivalent})^2-6\times(\text{Cu equivalent})$ to calculate a surface crack index, and predicting the generation of surface defect of the thin slab hot rolled coil by the surface crack index.

Also according to embodiments of the present invention, a method of producing the thin slab hot rolled coil includes continuously casting the molten steel having the surface crack index of 1 or less calculated by the above method of predicting the surface quality of the hot rolled coil, into a thin slab, and hot rolling the thin slab, thereby producing the hot rolled coil.

The produced thin slab hot rolled coil has almost none of the surface crack defects.

In an electric arc furnace process for producing molten steel mainly using scraps, tramp elements such as Cu, Ni, Sn, As, Cr, Mo, Pb, etc., which are not removed in a typical steel-making process remain in steel. The tramp elements are a general term of trace elements which negatively affect the quality of iron steel products, and are difficult to remove in the steel-making process.

Figure 1:
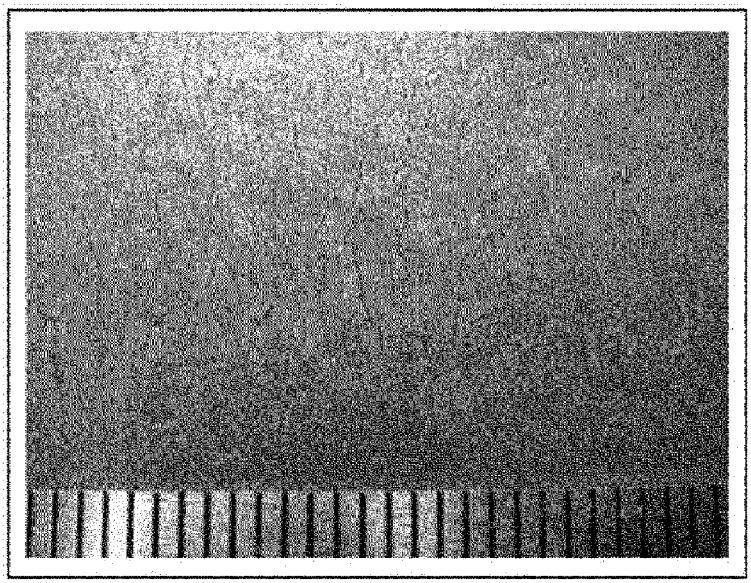
FIG. 1 is a photograph showing the surface crack defect generated on a hot rolled coil.

When a thin slab is produced from the molten steel containing a large amount of Cu, Sn, etc. among such tramp elements, as shown in FIG. 1, the surface crack defects in the form of bamboo shoots may occur on the hot rolled coil made from the thin slab.

When there are surface defects or inner defects in the hot rolled coil made from the thin slab, it is very difficult to remove and fix such defects in subsequent processes. Thus, the thin slab hot rolled coil having such defects cannot be sold as a normal product, and monetary losses occur.

Hence, the Cu equivalent is applied to predict the surface crack defects.

Specifically, the Cu equivalent (Cu eq.) of the molten steel is calculated, and the calculated Cu equivalent of the molten steel is applied into the equation: $120\times(\text{Cu equivalent})^2-6\times(\text{Cu equivalent})$. When the calculated value is 1 or less, the thin slab produced using continuous casting is used to produce a strict grade product. On the other hand, when the calculated value ranges from more than 1 to 2, the thin slab produced using continuous casting is applied to produce a hot rolled coil of general grade product.

Although the composition ratio of the scrap can be controlled, the tramp elements contained in the scrap are difficult to be removed during the steel-making process. Thus, the Cu equivalent of the molten steel is calculated and the surface crack index is calculated from the Cu equivalent, and the thin slab may be used to produce the hot rolled coil of either the strict grade product or the general grade product.

The surface crack index can quantitatively represent the generation rate of the surface cracks which are the typical surface defects of the thin slab hot rolled coil.

The surface crack index ranging from 1 to 2 is regarded as allowable for the hot rolled coil of the general grade product. In the hot rolled coil of strict grade product, the surface crack index should be 1 or less.

The strict grade product is used to represent a hot rolled coil, the surface defect standard of which should be strictly controlled, in which the surface crack generation rate is 10% or less per sheet area.

The standard of surface crack index is shown in Table 1 below.

TABLE 1

| Surface crack Index | Surface crack Generation Rate |
|---|---|
| 1 or less | 10% or less per sheet area |
| from more than 1 to 2 | 30% or less per sheet area |
| from more than 2 to 3 | 40% or less per sheet area |
| from more than 3 to 4 | 50% or less per sheet area |
| more than 5 | 70% or less per sheet area |

As is apparent from Table 1, when the surface crack index is calculated to be 1 or less, the resulting hot rolled coil can have a surface crack generation rate of 10% or less per sheet area. If the surface crack index ranges from 1 to 2, the hot rolled coil can have a surface crack generation rate of 30% or less per sheet area.

The surface crack index is calculated from the Cu equivalent of the molten steel.

The surface crack index is more correlated with Cu equivalent than with the amount of Cu.

Figure 2:
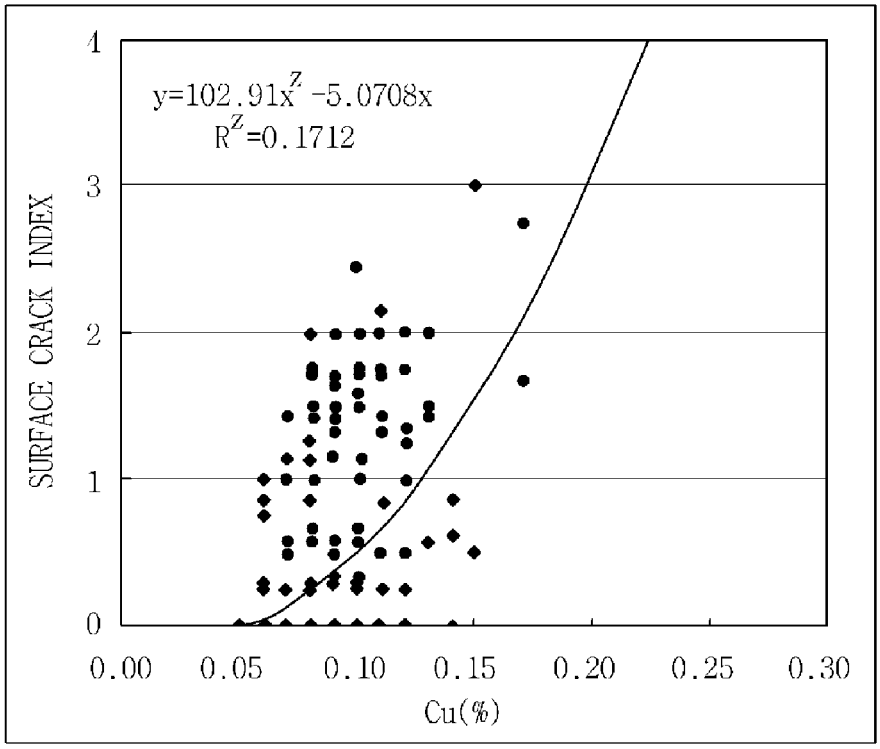
FIG. 2 is a graph showing the correlation between the surface crack index and the amount of Cu.
Figure 3:
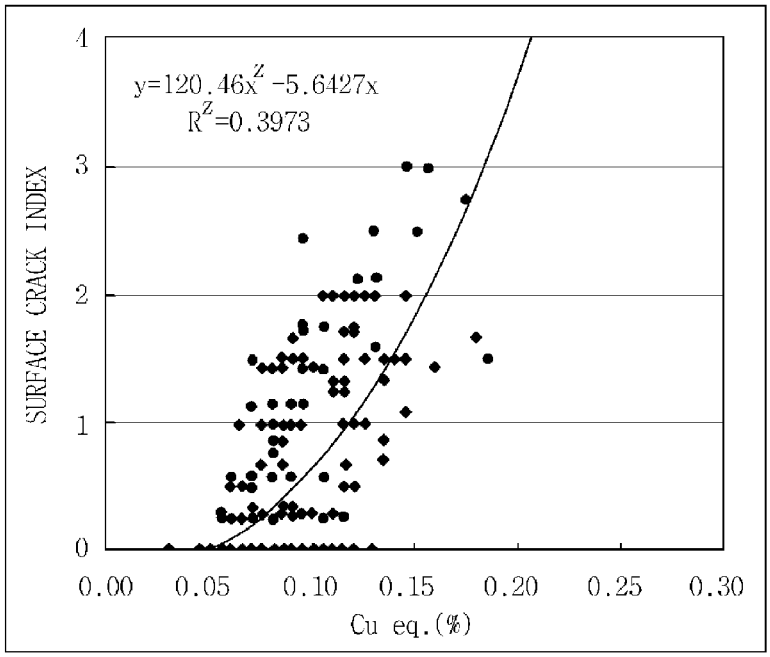
FIG. 3 is a graph showing the correlation between the surface crack index and the Cu equivalent.

As shown in FIGS. 2 and 3, the coefficient of correlation between the surface crack index and the amount of Cu is 41% ($R^2$=0.1712), whereas the coefficient of correlation between the surface crack index and the Cu equivalent is 63% ($R^2$=0.3973). This means that the surface crack (surface defect) of the thin slab hot rolled coil may be predicted by calculating the Cu equivalent of the molten steel.

Hence, the surface crack index for indicating the surface crack generation rate is calculated before the thin slab is produced into a hot rolled coil.

The surface crack index is determined by calculating the Cu equivalent (Cu eq.) of the molten steel and applying the calculated Cu equivalent of the molten steel into the equation: $120\times(\text{Cu equivalent})^2-6\times(\text{Cu equivalent})$.

In order to satisfy the surface crack index: $120\times(\text{Cu equivalent})^2-6\times(\text{Cu equivalent})\leqq 2$, the Cu equivalent of the molten steel is 0.156 or less, and the Cu equivalent is 0.119 or less in order to satisfy $120\times(\text{Cu equivalent})^2-6\times(\text{Cu equivalent})\leqq 1$ for use in the strict grade product.

The Cu equivalent is calculated by the equation: [wt % Cu]+5[wt % Sn]+8[wt % Sb]−[wt % Ni]. As such, wt % means the amount of each of Cu, Sn, Sb, and Ni.

Specifically, the Cu equivalent is determined by measuring the amounts of Cu, Sn, Sb and Ni of molten steel and then substituting the amount of each element into the equation: [wt % Cu]+5[wt % Sn]+8[wt % Sb]−[wt % Ni].

The Cu equivalent (Cu eq.) is obtained by converting the effects of Cu, Sn, Sb and Ni among tramp elements relative to Cu.

Cu, Sn, Sb and Ni which are the tramp elements contained in the scrap are present as substitution solid-solution elements in the steel, and these exhibit solid-solution reinforcing effects but generate the surface defect of the thin slab.

Among the tramp elements, Cu is concentrated on the interface of Fe scales when the thin slab is reheated or hot rolled, undesirably causing surface defects.

In the case where Sn is used alone in the steel without Cu, it is not concentrated on the interface of the Fe scales but is diffused into the base Fe, and thus does not cause the surface defect. However, in the case where Sn is used together with Cu, it is concentrated on the interface of the Fe scales, undesirably causing the surface defects.

Sb has a high tendency of generating the surface defects of the thin slab.

When Ni is added in an amount equal to that of Cu, the solid solubility of Cu in austenite is increased, thus reducing the generation of surface defects.

Taking into consideration the correlation of Cu, Sn, Sb and Ni, the Cu equivalent is shown.

The amounts of Cu, Sn, Sb and Ni for calculating the Cu equivalent are measured by sampling the molten steel immediately before continuous casting after completion of refining. For reference, sampling the molten steel means that a portion of the molten steel is taken as a sample. The molten steel is sampled immediately before continuous casting after completion of refining, and the amounts of Cu, Sn, Sb and Ni elements (tramp elements) in addition to the main elements for the molten steel are measured.

Table 2 below shows the correlation between the surface crack index calculated from the Cu equivalent (Cu eq.) of the molten steel and the surface crack defect of the thin slab hot rolled coil.

Test Method: the molten steel was sampled immediately before continuous casting after completion of refining, the amounts of Cu, Sn, Sb and Ni of the molten steel were measured, and the amounts of respective elements were substituted into the equation: [wt % Cu]+5[wt % Sn]+8[wt % Sb]−[wt % Ni] to calculate the Cu equivalent.

The calculated Cu equivalent was applied into the equation: $120\times(\text{Cu equivalent})^2-6\times(\text{Cu equivalent})$ to calculate the surface crack index.

In this way, whenever continuous casting was performed, the molten steel immediately before continuous casting was sampled, the surface crack index was calculated, and the molten steel having the surface crack index of each of 0.5, 1, 2 and 3 was continuously cast into a thin slab which was then hot rolled into a hot rolled coil.

Then, the surface crack defect of the surface of the thin slab hot rolled coil was measured.

TABLE 2

| | Cu eq. (w %) in Molten steel | Surface crack Index | Generation of Surface crack Defect | Note |
|---|---|---|---|---|
| 1 | 0.094 | 0.5 | No | Inventive Steel |
| 2 | 0.119 | 1 | Yes (5% per sheet area) | Inventive Steel |
| 3 | 0.156 | 2 | Yes (28% per sheet area) | Inventive Steel |
| 4 | 0.185 | 3 | Yes (40% per sheet area) | Comparative Steel |

[Surface crack index: $120\times(\text{Cu equivalent})^2-6\times(\text{Cu equivalent})$, Cu equivalent: [wt % Cu] + 5[wt % Sn] + 8[wt % Sb] − [wt % Ni]]

As is apparent from Table 2, when the surface crack index obtained by applying the Cu equivalent of the molten steel into the equation: $120\times(\text{Cu equivalent})^2-6\times(\text{Cu equivalent})$ was 1 or less, the surface crack defect was never generated on the thin slab hot rolled coil, or even when the surface crack defects were generated, the generation rate thereof was insignificant (Inventive Steels 1, 2).

In the results of calculation of the Cu equivalent of the molten steel, when the surface crack index based on $120\times(\text{Cu equivalent})^2-6\times(\text{Cu equivalent})$ was in the range of from more than 1 to 2, the surface crack defects were generated on the thin slab hot rolled coil but the generation rate thereof was in the allowable level (Inventive Steel 3).

However, in the results of calculation of the Cu equivalent of the molten steel, when the surface crack index based on $120\times(\text{Cu equivalent})^2-6\times(\text{Cu equivalent})$ was more than 2, the severe surface crack defects were generated on the thin slab hot rolled coil (Comparative Steel 4).

As mentioned above, when the Cu equivalent is calculated by sampling the molten steel immediately before continuous casting after completion of refining and the surface crack index is calculated from the Cu equivalent, the generation of the surface crack defects of the hot rolled coil produced from the thin slab made of the molten steel can be predicted. Thus, it is possible to provide the thin slab suitable for the quality standard demanded by a consumer.

For example, the Cu equivalent (Cu eq.) of the molten steel is calculated, and the calculated Cu equivalent of the molten steel is applied into the equation: $120\times(\text{Cu equivalent})^2-6\times(\text{Cu equivalent})$ to determine the surface crack index, after the molten steel having the surface crack index of 1 or less is continuously cast into the thin slab which is then hot rolled into a hot rolled coil. Thus, the surface crack defect can be minimized, and thus the surface quality of the thin slab hot rolled coil can be improved.

(Second Embodiment)

According to another embodiment of the present invention, a method of predicting surface quality of a thin slab hot rolled coil includes calculating the Cu equivalent (Cu eq.) of molten steel, substituting the calculated Cu equivalent of the molten steel and a coil thickness to be produced into an equation: (Cu equivalent×100)+(1.5×coil thickness) to determine a correction value A, applying the correction value A into an equation: $0.0067\times A^2-0.088\times A$ to calculate a surface crack index, and predicting the generation of surface defect of the thin slab hot rolled coil by the surface crack index.

Also a method of producing the thin slab hot rolled coil according to another embodiment of the present invention includes continuously casting the molten steel having the surface crack index of 1 or less calculated using the above method of predicting the surface quality of the hot rolled coil into a thin slab, and then hot rolling the thin slab into a hot rolled coil.

The second embodiment of the present invention further takes into consideration the coil thickness of the hot rolled coil to be produced, which is different from the first embodiment.

The surface crack index is more correlated with the Cu equivalent than with the amount of Cu, and also is correlated with the coil thickness of the hot rolled coil to be produced. Specifically, in a thin slab process for producing a hot rolled coil using molten steel in an electric arc furnace, the surface crack is highly correlated with the Cu equivalent and the coil thickness of the hot rolled coil.

This is because the surface crack generation rate is increased when the coil thickness of the hot rolled coil to be produced is thick even if the Cu equivalent is low.

Figure 4:
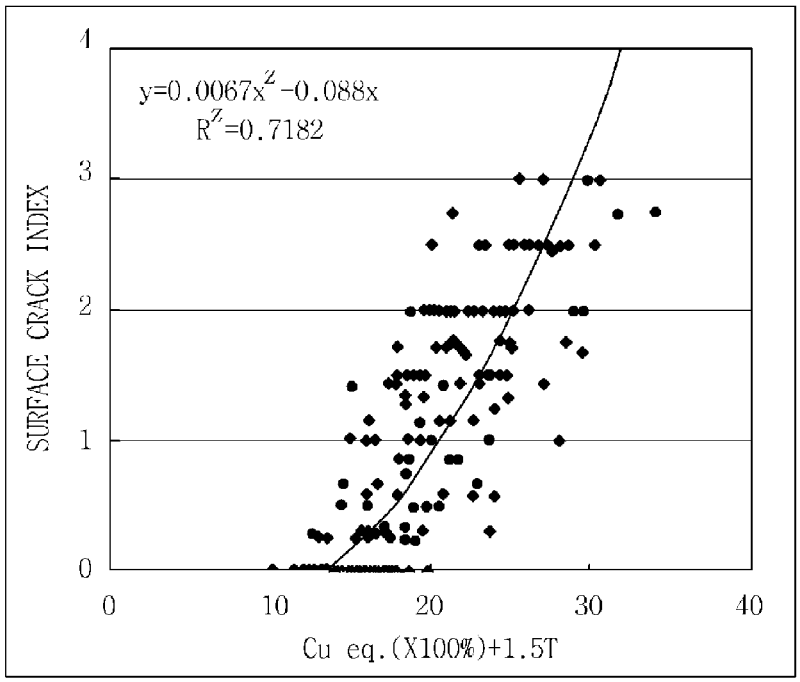
FIG. 4 is a graph showing the correlation between the surface crack index and the Cu equivalent and the coil thickness.

As shown in FIGS. 2 to 4, the coefficient of correlation between the surface crack index and the amount of Cu is 41% ($R^2$=0.1712), and the coefficient of correlation between the surface crack index and the Cu equivalent is 63% ($R^2$=0.3973). Whereas, the coefficient of correlation between the surface crack index and the Cu equivalent and the coil thickness is 85% ($R^2$=0.7182) which exceeds 80%.

In the thin slab process for producing a hot rolled coil using molten steel in an electric arc furnace, the surface crack has high correlation with two factors including the Cu equivalent and the coil thickness. Thereby, the generation rate of the surface crack (surface defect) of the thin slab hot rolled coil is predicted.

Specifically, the surface crack index is calculated from the equation: $0.0067\times A^2-0.088\times A$. A is the correction value obtained when the coil thickness and the Cu equivalent are applied to an equation (Cu equivalent×100)+(1.5×coil thickness (T)).

The surface crack index equation: $0.0067\times A^2-0.088\times A$ wherein A=(Cu equivalent×100)+(1.5×coil thickness) is deduced from the correlation graph of FIG. 4.

In the results of a plurality of tests, the surface crack generation rate increased as the Cu equivalent increased, and also the surface crack generation rate increased as thickness of the hot rolled coil to be produced increased under conditions of the same Cu equivalent.

In particular, the value obtained by adding the 100 times value of Cu equivalent and the 1.5 times value of coil thickness had high correlation with the surface crack index, which was graphed, whereby the surface crack index equation: $0.0067\times A^2-0.088\times A$ wherein A=(Cu equivalent×100)+(1.5×coil thickness (T)) was deduced.

The Cu equivalent is calculated by the equation: k1[wt % Cu]+k2[wt % Sn]+k3[wt % Sb]+k4[wt % Ni]. The coefficients are k1=1, k2=5, k3=8, k432 −1. In the Cu equivalent equation, the element which greatly affects the surface crack defect is Cu, and the other coefficients except for Cu have predetermined allowable ranges.

Specifically, k2 of 3~8, k3 of 5~10, k4 of −0.7~1.5 are possible. In this case, however, the graph of FIG. 4 is parallel moved to the upward left or downward right, and the surface crack index and the coefficient of correlation are thus slightly decreased.

Hence, it is the most preferable that the Cu equivalent is calculated by the equation: [wt % Cu]+5[wt % Sn]+8[wt % Sb]−[wt % Ni].

The method of calculating the Cu equivalent and the standard of the surface crack index are the same as described in the first embodiment, and a description thereof is omitted.

When the surface crack index ranges from 1 to 2, it is allowable in a hot rolled coil of general grade product, and in the case of a hot rolled coil of strict grade product, the surface crack index is 1 or less, which is the same as in the first embodiment.

The process of predicting the surface quality of the thin slab hot rolled coil is described below.

The Cu equivalent (Cu eq.) of the molten steel immediately before continuous casting after completion of refining is calculated, and the calculated Cu equivalent of the molten steel and the coil thickness to be produced are applied into the equation: (Cu equivalent×100)+(1.5×coil thickness) to determine the correction value A in which the coil thickness to be produced is applied along with the Cu equivalent. The correction value A is applied into the equation: $0.0067\times A^2-0.088\times A$ to calculate the surface crack index.

If the calculated surface crack index is 1 or less, a thin slab produced using continuous casting may be applied to a strict grade product. If the calculated surface crack index ranges from 1 to 2, a thin slab produced using continuous casting may be employed in producing a hot rolled coil of general grade product.

The A that satisfies the surface crack index: $0.0067\times A^2-0.088\times A\leqq 2$ is 25 or less, and the A that satisfies $0.0067\times A^2-0.088\times A\leqq 1$ for the strict grade product is 20 or less.

The molten steel having the calculated surface crack index of 1 or less is continuously cast into the thin slab, which is then hot rolled into a hot rolled coil. Thereby, the hot rolled coil thus obtained can have almost none of the surface crack defect.

Briefly, the surface crack generation rate can be predicted by the surface crack index calculated before production of the hot rolled coil from the thin slab, thus enabling the production of a thin slab hot rolled coil adapted for the quality standard demanded by a consumer.

Table 3 below shows the correlation between the surface crack index calculated from the Cu equivalent (Cu eq.) of the molten steel and the coil thickness to be produced and the surface crack defects of the produced thin slab hot rolled coil.

Test Method: the molten steel is sampled immediately before continuous casting after completion of refining, the amounts of Cu, Sn, Sb and Ni which are the tramp elements in the molten steel are measured, and these amounts are substituted into the equation: [wt % Cu]+5[wt % Sn]+8[wt % Sb]−[wt % Ni] to calculate the Cu equivalent (Cu eq.).

The calculated Cu equivalent and the coil thickness demanded by a consumer are substituted into the equation: (Cu equivalent×100)+(1.5×coil thickness), and thus the correction value A is determined.

The determined correction value A is substituted into the equation: $0.0067\times A^2-0.088\times A$ to calculate the surface crack index.

Subsequently, the molten steel is continuously cast into the thin slab which is then hot rolled into the hot rolled coil. As such, in the case where the thin slab produced by continuously casting the molten steel having the surface crack index of each of 0.5, 1, 2 and 3 calculated using the above process was manufactured into a hot rolled coil, the surface crack generation rate of the actual hot rolled coil was measured.

TABLE 3

| | Cu Eq. (wt %) in Molten Steel | Coil Thick. (mm) | A (Correction Value: coil thickness is applied to Cu eq.) | Surface crack Index | Generation of Surface crack of Hot rolled coil | Note |
|---|---|---|---|---|---|---|
| 1 | 0.094 | 5 | 17 | 0.5 | No | Inventive Steel (applied to surface strict material) |
| 2 | 0.119 | 5 | 20 | 1 | Yes (5% per sheet area) | Inventive Steel (applied to surface strict material) |
| 3 | 0.175 | 5 | 25 | 2 | Yes (25% per sheet area) | Inventive Steel (applied to general material) |
| 4 | 0.205 | 5 | 28 | 3 | Yes (37% per sheet area) | Comparative Steel (poor) |
| 5 | 0.02 | 10 | 17 | 0.5 | No | Inventive Steel (applied to surface strict material) |
| 6 | 0.05 | 10 | 20 | 1 | Yes (4.5% per sheet area) | Inventive Steel (applied to surface strict material) |
| 7 | 0.1 | 10 | 25 | 2 | Yes (26% per sheet area) | Inventive Steel (applied to general material) |
| 8 | 0.129 | 10 | 28 | 3 | Yes (36% per sheet area) | Comparative Steel (poor) |
| 9 | 0.02 | 20 | 32 | 4 | Yes (48% per sheet area) | Comparative Steel (poor) |

As is apparent from Table 2, the Cu equivalent of the molten steel and the coil thickness to be produced are substituted into the equation: (Cu equivalent×100)+(1.5×coil thickness) to determine the correction value A, which is then applied into the equation: $0.0067\times A^2-0.088\times A$ to determine the surface crack index. As such, when the surface crack index was 1 or less, the surface crack defect was never generated on the thin slab hot rolled coil, or even when the surface crack defects were generated, the generation rate thereof was insignificant (Inventive Steels 1, 2, 5, 6).

Also, when the surface crack index was in the range of from more than 1 to 2, the surface crack defects were generated on the thin slab hot rolled coil, but the generation rate thereof was typically allowable (Inventive Steels 3, 7).

However, the surface crack index exceeding 2 resulted in generation of severe surface crack defects on the thin slab hot rolled coil (Comparative Steels 4, 8).

Furthermore, under conditions of the same Cu equivalent of the molten steel, when the coil thickness was thin, the surface crack defect did not occur, whereas when the coil thickness was thick the surface crack defects were generated (Inventive Steel 5, Comparative Steel 9). For reference, the slab thickness resulting from continuously casting the thin slab is 40~100 mm, and the thickness of the hot rolled coil is 4~20 mm.

As mentioned above, the molten steel is sampled immediately before continuous casting after completion of refining, the Cu equivalent is calculated, and the Cu equivalent of the molten steel and the coil thickness to be produced are applied to calculate the surface crack index, and the surface crack defect generated upon production of the hot rolled coil from the thin slab made of the molten steel can be predicted. Therefore, it is possible to provide the thin slab adapted for the quality standard demanded by a consumer.

For example, the Cu equivalent of the molten steel is calculated, and the calculated Cu equivalent of the molten steel and the coil thickness to be produced are applied into the equation: (Cu equivalent×100)+(1.5×coil thickness) to determine the correction value A. This correction value A is applied into the equation: $0.0067\times A^2-0.088\times A$ to calculate the surface crack index. The molten steel having the calculated surface crack index of 1 or less is continuously cast into the thin slab which is then hot rolled into a hot rolled coil. Thereby, the surface crack defect can be minimized, and the surface quality of the thin slab hot rolled coil can be improved.

(Third Embodiment)

According to a further embodiment of the present invention, a method of producing a thin slab hot rolled coil includes predicting the generation of surface defect of the thin slab hot rolled coil based on a surface crack index deduced by the correlation between the Cu equivalent (Cu eq.) of molten steel and a coil thickness, and determining the coil thickness to be produced.

The third embodiment of the present invention is a method of minimizing the surface crack defect which is the typical surface defect of the hot rolled coil produced from the thin slab. According to the third embodiment, the coil thickness to be produced is variably determined depending on the Cu equivalent calculated in the molten steel process when producing the hot rolled coil from the thin slab, which is different from the second embodiment.

Specifically, the Cu equivalent (Cu eq.) of the molten steel is calculated, and the calculated Cu equivalent of the molten steel and the coil thickness to be produced are applied into the equation: (Cu equivalent×100)+(1.5×coil thickness) to determine a correction value A, after which the correction value A is applied into the equation: $0.0067\times A^2-0.088\times A$ to calculate the surface crack index, and the generation of surface defect of the thin slab hot rolled coil is predicted by the surface crack index. Based on the predicted results, the coil thickness to be produced is determined in the range that prevents the surface defects from generating.

Figure 5:
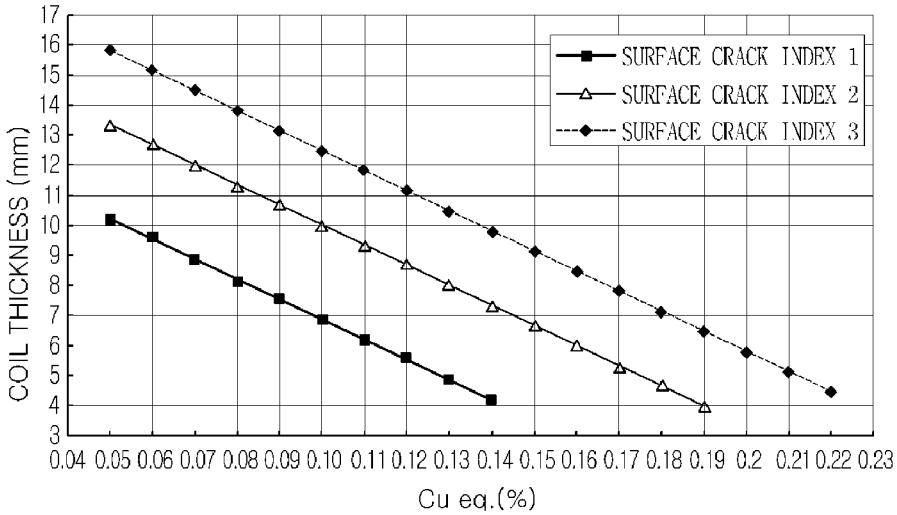
FIG. 5 is a graph showing the correlation between the Cu equivalent and the coil thickness, deduced by the surface crack index equation.

As shown in FIG. 5, when the coil thickness is thick in spite of the low Cu equivalent, the surface crack generation rate is high.

For example, under conditions of the Cu equivalent being 0.1, the rolling process at the coil thickness of 7 results in that the surface crack index is predicted to be 1, whereas the rolling process at the coil thickness of 10 results in that the surface crack index is predicted to be 2.

Thus, the Cu equivalent of the molten steel is calculated, and the surface crack index is predicted from the calculated Cu equivalent of the molten steel, and the coil thickness adapted for the quality standard demanded by a consumer is determined.

Typically, in the continuous casting, the number of pouring events of molten steel into a tundish is generally set to six or nine even though it depends on the kind of steel. This means that the Cu equivalent of the molten steel may vary whenever continuous casting is performed.

Upon rolling of the continuously cast slab, the final coil thickness has the upper limit and the lower limit depending on the kind of steel. Thus, the Cu equivalent of the molten steel is calculated immediately before continuous casting after completion of refining, and the coil thickness is determined so that the surface crack index of demanded quality is obtained from the calculated Cu equivalent of the molten steel, and then the rolling process is performed.

The method of calculating the Cu equivalent and the standard of the surface crack index are the same as in the second embodiment, and a description thereof is omitted.

The method of producing the thin slab hot rolled coil is described below.

For example, the Cu equivalent (Cu eq.) of the molten steel is calculated immediately before continuous casting after completion of refining, and the calculated Cu equivalent of molten steel and the coil thickness to be produced are substituted into the equation: (Cu equivalent×100)+(1.5×coil thickness) to determine the correction value A. The correction value A is applied into the equation: $0.0067\times A^2-0.088\times A$ to calculate the surface crack index.

The generation of surface defect of the thin slab hot rolled coil is predicted by the surface crack index. The coil thickness is determined based on the predicted results.

As such, the coil thickness may be determined to be a value in the range in which the calculated surface crack index meets the surface crack index of demanded quality.

In addition, for example, if there is the request of a consumer, the production amount and width of the hot rolled coil to be produced are determined.

The correlation between the Cu equivalent and the coil thickness based on the surface crack index equation: $0.0067\times A^2-0.088\times A$ wherein A=(Cu equivalent×100)+(1.5×coil thickness) is deduced, and data for predicting the generation of surface defect of a hot rolled coil are obtained.

Subsequently, the Cu equivalent (Cu eq.) of the molten steel is calculated immediately before continuous casting after completion of refining. Based on the calculated Cu equivalent of the molten steel and the predicted data, the coil thickness to be produced is determined. As such, the coil thickness is determined so as to achieve the surface crack index that meets the quality standard demanded by a consumer.

For example, as shown in FIG. 5, when the calculated Cu equivalent of the molten steel is 0.1, the coil thickness is determined to be 7 or less in order to achieve the surface crack index of 1 or less, and rolling is then performed. Also, when the calculated Cu equivalent of the molten steel is 0.07, the coil thickness is determined to be 9 or less in order to achieve the surface crack index of 1 or less, and rolling is then conducted.

When the calculated Cu equivalent of the molten steel is 0.1, the coil thickness is determined to be 10 or less in order to achieve the surface crack index of 2 or less, and then the rolling process is performed.

In the case where the Cu equivalent of the molten steel calculated in the range that meets the quality standard demanded by a consumer is low, the coil thickness can be determined to be thick. In contrast, if the Cu equivalent is comparatively high, the coil thickness may be determined to be thin, and then the rolling process may be performed.

Briefly, the generation of surface defect of the thin slab hot rolled coil is predicted by using the Cu equivalent for the surface crack index, and the coil thickness can be then determined.

Figure 6:
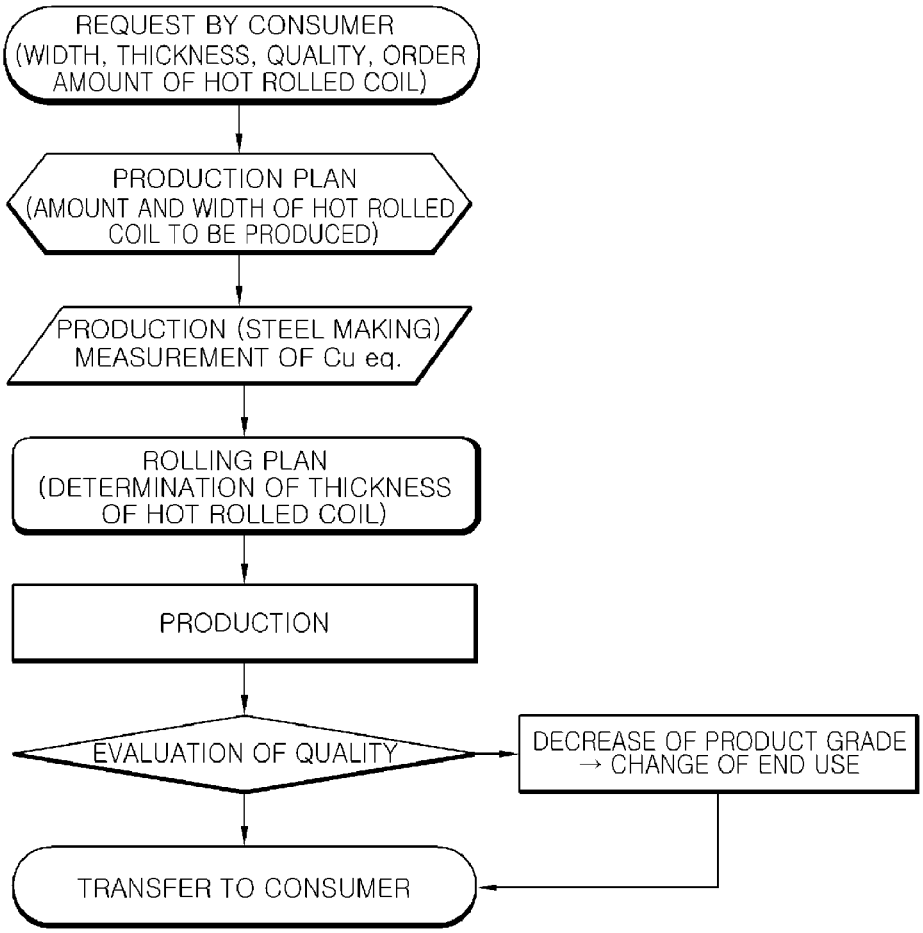
FIG. 6 is a flowchart showing the process of predicting the surface quality of a thin slab hot rolled coil and the process of producing the thin slab hot rolled coil using the same, according to an embodiment of the present invention.

As shown in FIG. 6, the method of producing the thin slab hot rolled coil for reducing the surface defect of the hot rolled coil includes (1) determining the production by the request of a consumer, (2) measuring the amounts of Cu, Sn, Sb and Ni of the molten steel upon production to calculate the Cu equivalent (Cu eq.), (3) applying the calculated Cu equivalent of the molten steel into a surface crack index deduced by the correlation between the Cu equivalent (Cu eq.) of molten steel and the coil thickness, thereby determining the coil thickness to be produced so that the generation of surface defect is suppressed, and (4) continuously casting the molten steel into a thin slab which is then hot rolled to have the coil thickness determined in step (3) into the hot rolled coil.

As mentioned above, the Cu equivalent of the molten steel is calculated, and the coil thickness to be produced is determined based on the surface crack index deduced by the correlation between the Cu equivalent (Cu eq.) of the molten steel and the coil thickness, and then rolling is performed to manufacture the hot rolled coil that satisfies the surface quality demanded by a consumer.

In addition, even when the hot rolled coil produced using the above method does not meet a higher grade upon evaluation of quality thereof, it may be provided to a consumer by changing its grade from the strict grade product to a general grade product.

Table 4 below shows the results of rolling the coil when the coil thickness has been determined so that the surface crack index based on the Cu equivalent of the molten steel and the coil thickness to be produced satisfy the surface crack index for demanded quality.

TABLE 4

| Steel | Demanded quality (Surface crack Index) | Heat no. | Slab no. | $Cu_{eq}$ | Comparative Coil Thick. | Comparative Surface crack Index | Comparative Judge | Inventive Coil Thick. | Inventive Surface crack Index | Inventive Judge |
|---|---|---|---|---|---|---|---|---|---|---|
| A | 1 or less | 1 | 1 | 0.08 | 5 | 0.2 | Pass | 7 | 0.7 | Pass |
| A | 1 or less | 1 | 2 | 0.08 | 5 | 0.2 | Pass | 7 | 0.7 | Pass |
| A | 1 or less | 1 | 3 | 0.08 | 6 | 0.4 | Pass | 8 | 0.9 | Pass |
| A | 1 or less | 1 | 4 | 0.08 | 6 | 0.4 | Pass | 8 | 0.9 | Pass |
| A | 1 or less | 2 | 1 | 0.11 | 7 | 1.2 | Fail | 5 | 0.7 | Pass |
| A | 1 or less | 2 | 2 | 0.11 | 7 | 1.2 | Fail | 5 | 0.7 | Pass |
| A | 1 or less | 2 | 3 | 0.11 | 8 | 1.5 | Fail | 6 | 0.9 | Pass |
| A | 1 or less | 2 | 4 | 0.11 | 8 | 1.5 | Fail | 6 | 0.9 | Pass |
| B | 2 or less | 3 | 1 | 0.09 | 7 | 0.8 | Pass | 10 | 0.8 | Pass |
| B | 2 or less | 3 | 2 | 0.09 | 8 | 1.1 | Pass | 11 | 1.1 | Pass |
| B | 2 or less | 3 | 3 | 0.09 | 9 | 1.4 | Pass | 11 | 1.4 | Pass |
| B | 2 or less | 3 | 4 | 0.09 | 9 | 1.4 | Pass | 11 | 1.4 | Pass |
| B | 2 or less | 4 | 1 | 0.10 | 10 | 2.0 | Fail | 7 | 1.0 | Pass |
| B | 2 or less | 4 | 2 | 0.10 | 11 | 2.4 | Fail | 8 | 1.3 | Pass |
| B | 2 or less | 4 | 3 | 0.10 | 11 | 2.4 | Fail | 9 | 1.6 | Pass |
| B | 2 or less | 4 | 4 | 0.10 | 11 | 2.4 | Fail | 9 | 1.6 | Pass |

[Heat no.: the number of continuous-continuous casting operations, Slab no.: slab produced per continuous casting]

COMPARATIVE EXAMPLES

The molten steel is sampled immediately before continuous casting after completion of refining, the amounts of Cu, Sn, Sb and Ni which are the tramp elements in the molten steel are measured, and these amounts are applied into an equation: [wt % Cu]+5[wt % Sn]+8[wt % Sb]−[wt % Ni] to calculate a Cu equivalent (Cu eq.).

The calculated Cu equivalent and the coil thickness demanded by a consumer are substituted into an equation: (Cu equivalent×100)+(1.5×coil thickness) to determine a correction value A in which the coil thickness and the Cu equivalent are applied.

The determined correction value A is substituted into an equation: $0.0067\times A^2-0.088\times A$ to calculate a surface crack index. Thereafter, the molten steel is continuously cast into a thin slab which is then hot rolled into the hot rolled coil.

INVENTIVE EXAMPLES

The Cu equivalent and the coil thickness demanded by a consumer are substituted into an equation: (Cu equivalent×100)+(1.5×coil thickness) to determine a correction value A in which the coil thickness and the Cu equivalent are applied. The determined correction value A is substituted into an equation: $0.0067\times A^2-0.088\times A$ to calculate a surface crack index.

Thereby, the correlation between the Cu equivalent and the coil thickness for obtaining the surface crack index is deduced, and thus data for predicting the generation of surface defect of the thin slab hot rolled coil are obtained.

Subsequently, the molten steel is sampled immediately before continuous casting after completion of refining, and the amounts of Cu, Sn, Sb and Ni which are the tramp elements in the molten steel are measured, and the measured amounts are substituted into an equation: [wt % Cu]+5[wt % Sn]+8[wt % Sb]−[wt % Ni] to calculate the Cu equivalent (Cu eq.).

Based on the above predicted data, the coil thickness is determined so that the calculated Cu equivalent and the coil thickness to be produced satisfy the surface crack index for the demanded quality, and then rolling is performed.

Then, in view of the surface crack generation rate thereof, it is determined whether the quality of the actual hot rolled coil meets the demanded standard.

As shown in Table 4, in the comparative examples the produced hot rolled coil did not satisfy the surface crack index of 1 or less corresponding to the demanded quality. Although the surface crack index may be predicted from the Cu equivalent and the coil thickness to be produced, when the surface crack index does not satisfy the demanded quality, the hot rolled coil should be wasted and thus it is inefficient.

In the inventive examples, all of the hot rolled coils had the surface crack index of 1 or less corresponding to the demanded quality. This is because the coil thickness is determined in the range that satisfies the surface crack index of demanded quality.

When the Cu equivalent is low, the coil thickness can be determined to be thick in the range that satisfies the quality standard demanded by a consumer, and then rolling is performed. In contrast, when the Cu equivalent is high, the coil thickness is determined to be thin in the range that satisfies the quality standard demanded by a consumer, and then rolling is performed.

Even when the amount of hot rolled coil to be produced is determined by the request of a consumer, the coil thickness is variably determined in the range that satisfies the surface crack index, thus the actual yield is improved.

Although the embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method of making a hot rolled steel sheet, the method comprising:

measuring an amount of each of copper (Cu), tin (Sn), antimony (Sb) and nickel (Ni) contained in at least a portion of molten steel;

computing a copper equivalent value (Cu eq.) using the measured amount of each of Cu, Sn, Sb and Ni;

providing a thickness value for a hot rolled steel sheet to be produced;

estimating, using the copper equivalent value and a thickness value, the surface crack generation rate of the hot rolled steel sheet to be produced;

determining if the estimated surface crack generation rate is equal to or smaller than a predetermined value;

casting the molten steel into a slab; and hot rolling the slab into the hot rolled steel sheet having a thickness of about the thickness value, when determined that the estimated surface crack generation rate is equal to or smaller than the predetermined value.

2. The method of claim 1, wherein the copper equivalent value is computed by using the following equation:

Cu eq. (copper equivalent value)=k1×[wt % Cu]+k2×[wt % Sn]+k3×[wt % Sb]+k4×[wt % Ni], where wt % Cu, wt % Sn, wt % Sb and wt % Ni are weight percent amounts of Cu, Sn, Sb and Ni in the molten steel, respectively, where each of k1, k2, k3 and k4 is a number which is not zero.

3. The method of claim 1, wherein k1 is 1, k2 ranges from 3 to 8, k3 ranges from 5 to 10, and k4 ranges from −0.7 to −1.5.

4. The method of claim 1, wherein estimating comprises computing a surface crack index by using the following equations:

surface crack index=a3×{a1×(Cu eq.)+a2×(thickness value)}$^2$−a4×{a1×(Cu eq.)+a2×(thickness value)}, where each of a1, a2, a3 and a4 is a number greater than 0, and wherein the surface crack generation rate is estimated using the surface crack index.

5. The method of claim 1, further comprising:

providing a modified thickness value, when determined that the estimated surface crack generation rate is greater than the predetermined value, estimating, using the copper equivalent value and the modified thickness value, the surface crack generation rate for the modified thickness value of the hot rolled steel sheet to be produced;

hot rolling the slab into a hot rolled steel sheet having a thickness of about the modified thickness value, when determined that the estimated surface crack generation rate for the modified thickness value is equal to or smaller than the predetermined value.

6. The method of claim 1, further comprising melting steel scraps into the molten steel.

7. The method of claim 1, further comprising refining the molten steel, wherein the portion of molten steel is sampled to measure the amount of each of Cu, Sn, Sb and Ni after refining and before casting.

8. The method of claim 1, wherein the predetermined value is 30% of the area of the steel sheet.

9. A method of making a hot rolled steel sheet, the method comprising:

measuring an amount of each of copper (Cu), tin (Sn), antimony (Sb) and nickel (Ni) contained in at least a portion of molten steel;

computing a copper equivalent value using the measured amount of each of Cu, Sn, Sb and Ni;

estimating, using the copper equivalent value, a surface crack generation rate of the hot rolled steel sheet to be produced;

determining if the estimated surface crack generation rate is equal to or smaller than a predetermined value;

casting the molten steel into a slab; and hot-rolling the slab into the hot rolled steel sheet when the estimated surface crack generation rate is smaller than the predetermined value.

10. The method of claim 9, wherein the copper equivalent value is computed by using the following equation:

Cu eq. (copper equivalent value)=k1×[wt % Cu]+k2×[wt % Sn]+k3×[wt % Sb]+k4×[wt % Ni], where wt % Cu, wt % Sn, wt % Sb and wt % Ni are weight percent amounts of Cu, Sn, Sb and Ni in the molten steel, respectively, where each of k1, k2, k3 and k4 is a number which is not zero.

11. The method of claim 9, wherein k1 is 1, k2 ranges from 3 to 8, k3 ranges from 5 to 10, and k4 ranges from −0.7 to −1.5.

12. The method of claim 9, wherein estimating comprises computing a surface crack index by using the following equations:

surface crack index=b1×(Cu eq.)$^2$−b2×(Cu eq.), where each of b1 and b2 is a number greater than 0, and wherein the surface crack generation rate is estimated using the surface crack index.

13. The method of claim 1, further comprising melting steel scraps into the molten steel.

14. The method of claim 1, further comprising refining the molten steel, wherein the portion of molten steel is sampled to measure the amount of each of Cu, Sn, Sb and Ni after refining and before casting.

* * * * *

UNITED STATES PATENT AND TRADEMARK OFFICE

CERTIFICATE OF CORRECTION

PATENT NO. : 8,220,525 B2
APPLICATION NO. : 13/310132
DATED : July 17, 2012
INVENTOR(S) : Cho et al.

It is certified that error appears in the above-identified patent and that said Letters Patent is hereby corrected as shown below:

In the Specification:

In column 8 at line 17, Change “k432-1.” to --k4=-1.--.

In the Claims:

In column 15 at line 1, In Claim 1, change “a thick” to --the thick--.

In column 15 at line 2, In Claim 1, change “the surface crack generation rate” to --a surface crack generation rate--.

Signed and Sealed this
Thirteenth Day of August, 2013

Teresa Stanek Rea
*Acting Director of the United States Patent and Trademark Office*